United States Patent [19]

Nakano

[11] Patent Number: 4,753,283

[45] Date of Patent: Jun. 28, 1988

[54] APPARATUS FOR INJECTION OF MOLTEN METAL IN HORIZONTAL INJECTION TYPE DIE CASTING MACHINE

[76] Inventor: Akio Nakano, 14-1, Ichikawaminami 3-chome, Ichikawa-shi, Chiba-ken, Japan

[21] Appl. No.: 934,658

[22] Filed: Nov. 25, 1986

[30] Foreign Application Priority Data

Nov. 30, 1985 [JP] Japan ..... 60-270485

[51] Int. Cl.[4] ..... B22D 17/10; B22D 17/30

[52] U.S. Cl. ..... 164/312; 164/335

[58] Field of Search ..... 164/113, 119, 303–318, 164/335

[56] References Cited

FOREIGN PATENT DOCUMENTS 1242807 6/1967 Fed. Rep. of Germany ..... 164/312
2320761 11/1974 Fed. Rep. of Germany ..... 164/312
168897 10/1959 Sweden ..... 164/312

*Primary Examiner*—Nicholas P. Godici
*Assistant Examiner*—Richard K. Seidel
*Attorney, Agent, or Firm*—Klauber & Jackson

[57] ABSTRACT

The present invention relates to an improvement of an injection apparatus in a die casting machine of a horizontal injection type in which molten metal is poured into an injection sleeve mounted and held in a horizontal state with a fore end opening connected to an inlet of a die, and the poured molten metal is injected into the die by a piston motion of a plunger of an injection cylinder. A storage vessel capable of being sealed hermetically is attached to a pouring port formed in the injection sleeve and molten metal in a heat retaining furnace is supplied to the storage vessel periodically through a feed pipe, whereby the pouring into the injection sleeve is quickened to thereby increase the number of shots per hour despite the die casting machine having the injection apparatus of a horizontal injection type.

3 Claims, 1 Drawing Sheet

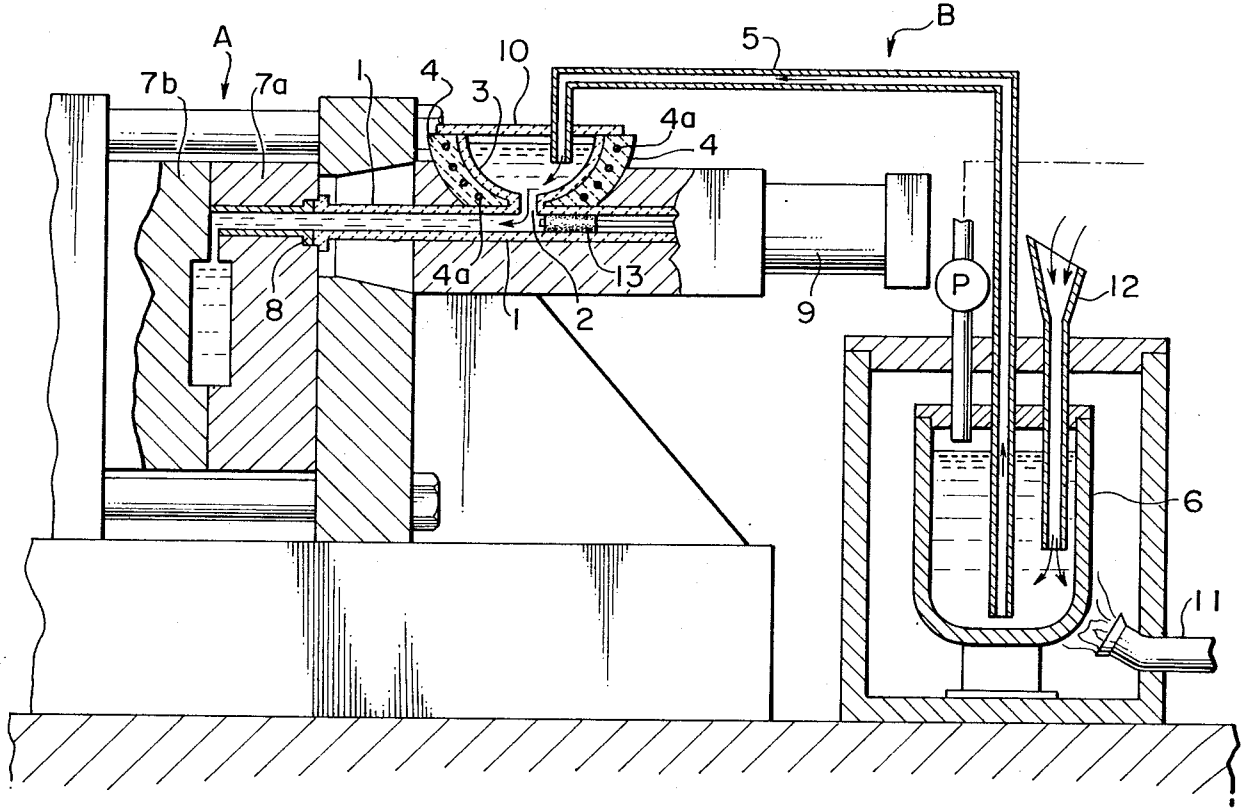
B
5
4a
4
10
3
4
1
7a
A
7b
12
P
9
13
2
1
4a
8
6
11

APPARATUS FOR INJECTION OF MOLTEN METAL IN HORIZONTAL INJECTION TYPE DIE CASTING MACHINE

FIELD OF THE INVENTION

The present invention relates to an apparatus for injection of molten metal in a horizontal injection type die casting machine and more particularly to a horizontal injection type apparatus for injection of molten metal having a high temperature of about 650° C. to about 1,200° C. in a die casting machine having such injection apparatus in which molten metal is poured into an injection sleeve mounted and held in a horizontal state and having a fore end opening connected to an inlet of a die, and the thus-poured molten metal is injected into the die by a piston motion of a plunger of an injection cylinder.

DESCRIPTION OF PRIOT ART

Conventional die casting machines having incorporated therein an injection apparatus of a horizontal injection type are usually cold chamber die casting machines.

Cold chamber die casting machines, unlike hot chamber die casting machines, are advantageous in that a heat retaining pot and a goose neck are not damaged by the heat of molten metal, piston motion of a plunger, or die closing vibrations, but are disadvantageous in that the number of shots per hour is small because pouring must be done at every shot.

The injection apparatus of the present invention is for injection of high temperature molten metal ranging in melting temperature from about 650° C. to about 1,200° C. As to the material of an injection sleeve and that of a molten metal storage vessel, conventional heat-resisting metals cannot stand long use under such high temperature condition.

OBJECTS AND SUMMARY OF THE INVENTION

It is an object of the present invention to increase the number of shots per hour while making the most of injection apparatus of a horizontal injection type.

It is another object of the present invention to make it possible to effect injection of metals having high melting temperatures in the range of about 650° C. to about 1,200° C.

It is a further object of the present invention to diminish the variation in molten metal temperature and thereby decrease the genetic rate of defective products caused by changes in temperature of molten metal.

Other objects of the present invention will become apparent from the following detailed description and the accompanying drawing.

The above objects are attained by a molten metal injection apparatus in a horizontal injection type die casting machine provided according to the present invention. In this injection apparatus, an injection sleeve is formed of a ceramic material, and a storage vessel formed of a ceramic material and capable of being sealed hermetically is attached to a pouring port formed in an upper surface of the injection sleeve. Further, a heat retaining member made of a ceramic material and containing an electric wire is provided along an outer surface of the storage vessel, and there is also provided a heat retaining furnace which supplies molten metal to the storage vessel through a feed pipe.

Under the above construction, the molten metal supplied from the heat retaining furnace and stored in the storage vessel is held at a predetermined temperature, and at every shot it is poured into the injection sleeve through the pouring port.

Vibrations from a plunger, etc. propagated to the storage vessel are absorbed by the heat retaining member provided along the outer surface of the same vessel.

BRIEF DESCRIPTION OF THE DRAWING

The drawing is a front view in longitudinal section of an injection apparatus according to an embodiment of the present invention, as mounted in a horizontal injection type die casting machine.

DETAILED DESCRIPTION

An embodiment of the present invention will be described hereinunder with reference to the drawing.

In FIG. 1, the mark B represents an injection apparatus mounted in a horizontal injection type die casting machine.

The injection apparatus B is composed of an injection sleeve 1 with a plunger 13 fitted therein, a storage vessel 3 attached to the sleeve 1, and a heat retaining furnace 6 which supplies molten metal to the vessel 3 through a feed pipe 5.

The injection sleeve 1, which is formed of a ceramic material, is connected at a fore end opening thereof to an inlet 8 of die portions *7a* and *7b* and held in a horizontal state. Into the sleeve 1 is inserted a plunger 13 adapted to perform a piston motion under the action of an injection cylinder 9. Because the injection sleeve 1 is formed from a ceramic material, it is necessary that the plunger 13 be a ceramic plunger.

A pouring port 2 is formed in an upper surface of the sleeve 1, and the storage vessel 3, which is formed in a bowl-like shape from a ceramic material, is attached to the pouring port 2 so that the molten metal in the storage vessel 3 flows into the injection sleeve 1 from the pouring port 2.

A heat retaining member 4 formed of a ceramic material and containing a heating wire *4a* is provided along the bottom of the storage vessel 3 so as to maintain the molten metal in the vessel 3 at a predetermined certain temperature. The opening of the vessel 3 can be closed with a cover plate 10 to prevent oxidation of the molten metal. The cover plate 10 is formed of a ceramic material.

Separately from the storage vessel 3 there is also provided a heat retaining furnace 6 formed of a ceramic material, having a larger capacity for the storage of molten metal and capable of being heat-retained by means of a burner 11. The heat retaining furnace 6 is connected with the storage vessel 3 through the feed pipe 5 so that molten metal stored in the heat retaining furnace 6 can be supplied to the storage vessel 3 through the feed pipe 5 when the molten metal in the vessel 3 becomes small in quantity.

Molten metal from a smelting furnace (not shown) is supplied into the heat retaining furnace 6 periodically through a supply pipe 12, and the molten metal in the furnace 6 is fed to the storage vessel 3 through the feed pipe 5 by the application of pressure into the furnace 6.

The following description is now provided about the composition and structure of the ceramic material which constitutes the injection sleeve 1, storage vessel 3, heat retaining member 4, cover plate 10 and plunger 13.

The ceramic material in question is a solid solution having the structure of $\alpha$-$Si_3N_4$ and it is an $\alpha$-sialonic sintered material having a dense phase of a composite (solid solution) structure obtained by calcining and interstitial solid-solubilizing of 60 vol % granular crystals ($\alpha$ phase) of $\alpha$-sialon of the formula $M_x(Si, Al)_{12}(O, N)_{16}$ wherein M is Mg, Ca, or Y into 40 vol % columnar crystals ($\beta$ phase) of $\beta$-$Si_3N_4$. It is superior in mechanical characteristics such as strength, hardness and fracture toughness as well as in resistance to thermal shock and to chemicals in a composition range which may be called a "partially stabilized" $\alpha$-sialon region in which 60 vol % $\alpha$-sialon granular crystals and 40 vol % $\beta Si_3N_4$ columnar crystals are coexistent.

The molten metal stored into the storage vessel 3 through the feed pipe 5 with increase in internal pressure of the heat retaining furnace 6 is heat-retained by the heat retaining member 4 and is poured into the injection sleeve 1 from the pouring port 2 at every shot, then injected into the die portions 7*a* and 7*b* by means of the plunger 13.

In the injection apparatus B of the above construction, the heat retaining furnace 6 is fixed firmly on the ground away from the body of the die casting machine and the molten metal in the heat retaining furnace 6 is fed to the storage vessel 3 through the feed pipe 5. Therefore, vibrations caused by the piston motion of the plunger 13 and by opening and closing of the die portions 7*a* and 7*b* are not propagated to the heat retaining furnace 6, thus permitting elongation of the life of the furnace 6 to a large extent.

Moreover, since the storage vessel 3 is reinforced by the heat retaining member 4 formed of a thick-walled ceramic material, it can stand long use even under application of vibrations of the plunger 13 and the die portions 7*a* and 7*b*.

According to the present invention, as set forth hereinabove, since the storage vessel is attached to the pouring port of the injection sleeve and there is provided the heat retaining furnace which supplies molten metal to the storage vessel through the feed pipe, it is possible to effect pouring of the molten metal in the storage vessel quickly at every shot, resulting in that the number of shots per hour can be increased despite a horizontal injection type apparatus. Besides, since the heat retaining furnace and the storage vessel are interconnected through the feed pipe, vibrations from the storage vessel are not propagated to the heat retaining furnace and hence the furnace is prevented from being loaded excessively. Consequently, the danger of the heat retaining furnace being damaged under the influence of such vibrations can be diminished. Moreover, since the storage vessel is reinforced by the heat retaining member of the ceramic material, even in the event the vibrations of the plunger, etc. are applied to the same vessel, the vibrations are absorbed by the heat retaining member, so that the durability of the storage vessel against vibrations is also improved.

Further, since the injection sleeve and the storage vessel as well as the cover plate thereof are formed from the ceramic material, both members are greatly improved in heat resistance and heat retaining property, so that not only it becomes possible to effect the injection of high temperature melting metals but also, coupled with the heat retaining effect of the heat retaining member, it is possible to reduce variations in molten metal temperature during injection, that is, the percentage of defective products resulting from changes of the molten metal temperature can be decreased.

Additionally, since the injection sleeve is formed of the ceramic material, the lubricity of the plunger which performs a piston motion during injection is improved.

What is claimed is:

1. An apparatus for the injection of molten metal in a horizontal injection type die casting machine, including:

an injection sleeve formed of a ceramic material and including a pouring port formed in an upper surface thereof;

a piston reciprocably slidable in said injection sleeve on opposite sides of said pouring port to inject molten metal poured through said pouring port into said sleeve, to a mold;

a storage vessel formed of a ceramic material, fixedly attached with said upper surface of said sleeve, said storage vessel having a lower opening fluidly connected with said pouring port formed in the upper surface of said injection sleeve to pour said molten metal into said sleeve, said storage vessel connected to said upper surface of said sleeve in surrounding relation to said lower opening in said storage vessel and said pouring port in the upper surface of said injection sleeve to provide a hermetic seal thereat;

an electrical heating wire embedded in an outer surface of said storage vessel;

insulation means formed of a ceramic material formed along the outer surface of said storage vessel for absorbing shocks and vibrations along the outer surface of said storage vessel;

a heat retaining furnace which supplies molten metal to said storage vessel; and a feed pipe for supplying molten metal from said heat retaining furnace to said storage vessel.

2. An apparatus for the injection of molten metal in a horizontal injection type die casting machine as set forth in claim 1, wherein said storage vessel can be sealed hermetically with a cover plate formed of a ceramic material.

3. An apparatus for the injection of molten metal in a horizontal injection type die casting machine, comprising:

an injection sleeve formed of a ceramic material and including a pouring port formed in an upper surface thereof;

a piston reciprocably slideable in said injection sleeve on opposite sides of said pouring port to inject molten metal poured through said pouring port into said sleeve, to a mold;

a storage vessel formed of a ceramic material, fixedly attached with said upper surface of said sleeve, said storage vessel having a lower opening fluidly connected with said pouring port formed in the upper surface of said injection sleeve to pour said molten metal into said sleeve; and, said storage vessel connected to said upper surface of said sleeve in surrounding relation to said lower opening in said storage vessel and said pouring port in the upper surface of said injection sleeve to provide a hermetic seal thereat;

an electrical heating wire embedded in an outer surface of said storage vessel;

insulation means formed of a ceramic material formed along the outer surface of said storage vessel for absorbing shocks and vibrations along the outer surface of said storage vessel;

a heat retaining furnace which supplies molten metal to said storage vessel; and a feed pipe for supplying molten metal from said heat retaining furnace to said storage vessel;

wherein the ceramic material is a solid solution having the structure of $\alpha$-$Si_3N_4$ an being an $\alpha$-sialonic sintered material of a dense phase of a composite structure which may be called a "partially stabilized" $\alpha$-sialon region in which 60 vol % $\alpha$-sialon granular crystals represented by the formula $Mx(SI, Al)_{12}(O, N)_{16}$ (M being Mg, Ca, or Y) and 40 vol % $\beta$-$Si_3N_4$ columnar crystals are consistent.

* * * * *